US005573431A

United States Patent [19]

Wurster

[11] Patent Number: 5,573,431

[45] Date of Patent: Nov. 12, 1996

[54] SOLDERLESS CONTACT IN BOARD

[76] Inventor: Woody Wurster, 502 W. Robinson, Carson City, Nev. 89703

[21] Appl. No.: 403,267

[22] Filed: Mar. 13, 1995

[51] Int. Cl.[6] ..... H01R 13/42

[52] U.S. Cl. ..... 439/751; 439/81

[58] Field of Search ..... 439/741, 745, 439/746, 751, 752, 80–83, 84

[56] References Cited

U.S. PATENT DOCUMENTS

| | | | |
|---|---|---|---|
| 4,274,699 | 6/1981 | Keim . | |
| 4,475,780 | 10/1984 | Walter . | |
| 4,586,778 | 5/1986 | Walter . | |
| 4,691,979 | 9/1987 | Manska . | |
| 4,728,164 | 3/1988 | Lemmens . | |
| 4,733,465 | 3/1988 | Tanaka . | |
| 4,746,301 | 5/1988 | Key . | |
| 4,761,498 | 8/1988 | Harting . | |
| 4,878,861 | 11/1989 | Kendall . | |
| 5,487,684 | 1/1996 | Schalk et al. | 439/751 |

*Primary Examiner*—David L. Pirlot
*Attorney, Agent, or Firm*—Freilich Hornbaker Rosen

[57] ABSTRACT

An electrical contact is provided for press-fit insertion into a circuit board, which produces a large retention force (resistance to pullout) with only moderate hole distortion, and which can be reliably produced at low cost. A press-fit section ( 14, FIG. 4) of the contact is of largely I-beam cross-section, with upper and lower flanges (60, 62) that each have outer faces (64, 66) for abutting the walls of the circuit board hole, and with a web (70) connecting the flanges. The entire cross-section of the contact is of rigid construction for minimal deformation when inserted into the hole, so most of the deformation is of the hole. Each flange face has about the same radius of curvature (C) as that of the hole, and the web is narrower than the flanges, but thick enough to avoid substantial bending.

6 Claims, 2 Drawing Sheets

SOLDERLESS CONTACT IN BOARD

BACKGROUND OF THE INVENTION

There is a need for a low cost miniature electrical contact that can be readily press-fit into a circuit board hole and provide a high retention force (resistance to pullout from the hole) with minimum hole distortion. One approach has been to form the contact with a compliant section that is compressed by the walls of the hole. However, the construction of miniature parts that will bend can increase the cost of the contacts. Another approach has been to provide rigid sections with sharp projections that cut into the hole walls, but this results in damage to the holes which may make them nonreusable. A miniature contact that could be constructed at low cost but that provided high retention force with minimal distortion or damage to the board hole, would be of value.

SUMMARY OF THE INVENTION

In accordance with embodiment of the present invention, an electrical contact is provided with a press-fit section that can be constructed at low cost and which provides high retention and relatively small distortion and damage to a circuit board hole. The press-fit section of the contact is of largely I-beam shape, with upper and lower flanges that each have convex outer faces for abutting the hole walls, and with a web connecting the flanges. The web is rigid against compression and bending that would move the flanges closer together, to keep the flanges firmly pressed against the hole walls. The outer face of each flange has about the same radius of curvature as the hole, to provide a large area of facewise contact with the hole to create a high retention force. The press-fit section is press fit into a hole whose initial diameter is about 7% less than the maximum distance between the outer faces. When inserted into the hole, the hole is slightly distorted towards an oval shape.

The novel features of the invention are set forth with particularity in the appended claims. The invention will be best understood from the following description when read in conjunction with the accompanying drawings.

DESCRIPTION OF THE PREFERRED EMBODIMENTS

Figure 1:
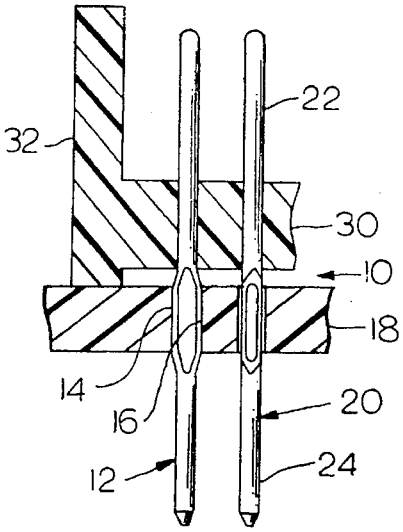
FIG. 1 is a partial sectional view of a combination of electrical contacts of one embodiment of the invention shown installed in a circuit board, and also showing a connector housing in which top sections of the contacts are mounted.

FIG. 1 illustrates a combination 10 of a contact 12 of the present invention, showing the press-fit section 14 thereof installed in a hole 16 of a circuit board 18. The figure shows another contact 20 of similar construction, but turned 90° from the orientation of the contact 12. The figure also shows top and bottom sections 22, 24 of the contacts, which are shown as of square cross-section, although they can be modified for different uses. The top sections 22 are shown projecting through a board 30 of a housing 32. The press-fit section 14 is designed to be installed in the circuit board hole 16 by merely pressing the section into the hole. As shown in FIG. 6, the hole 16 has plated hole walls 40 that extend to traces such as 42 on each surface 44, 46 of the board. In the usual case where the hole walls are plated, the contact is constructed to provide a high retention force (resistance to pullout) and low resistance electrical contact with the hole walls, which may extend to circuitry on or in the circuit board. The press-fit section 14 has top and bottom transition portions 15, 17 that lie respectively above and below the circuit board, and has a middle portion 19 of substantially constant cross section, with FIG. 5 showing a location along the middle portion 19.

Figure 4:
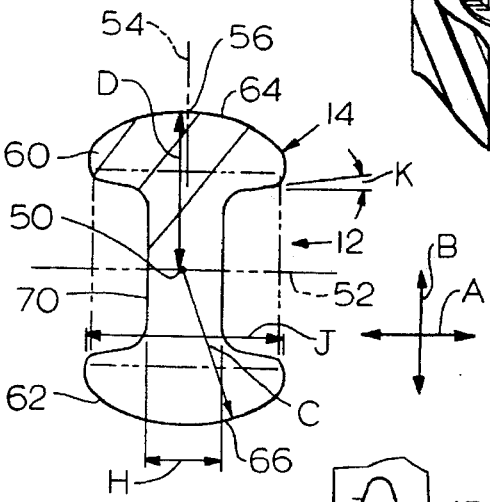
FIG. 4 is a sectional view of the press-fit section of the contact of FIG. 2, taken along the axis of the contact.

The press-fit section 14 has a substantially uniform cross-section along its height. As shown in FIG. 4, the press-fit section is symmetric about its axis 50, in that it is symmetric about an imaginary line 52 that extends in longitudinal directions A through the axis 50, and is symmetric about a perpendicular imaginary line 54 that extends in lateral directions B that are perpendicular to the longitudinal direction A and to the axis 50. The line 54 extends through the middles 56 of the opposite faces of the flanges.

The sectional view of FIG. 4 shows that the press-fit section is of largely H-beam, or I-beam shape, with upper and lower flanges 60, 62 that each have radially outer faces 64, 66 for abutting the walls of a hole, and with a web 70 that connects the flanges. The web extends longitudinally directly between the flanges, and is rigid against both compression in the lateral direction B and against any bending. Any such compression or bending could move the flanges closer together. Each flange outer face 64, 66 has radius of curvature C which is generally equal to the distance D of the surface from the axis 50, both before and after insertion of the contact into the circuit board hole. The radius of curvature C should be of the same order of magnitude as D and as the radius of the board hole. The radius C is preferably between 75% and 125% of the distance D, is more preferably between 80% and 110% of D, and is most preferably about 100% of D, to provide a large area of facewise contact with the walls of a hole. With the radius of curvature C being substantially no greater than the radius E (FIG. 5) of the hole, applicant avoids applying higher forces at the longitudinally opposite sides of the flanges but not at their middles 56.

Figure 5:
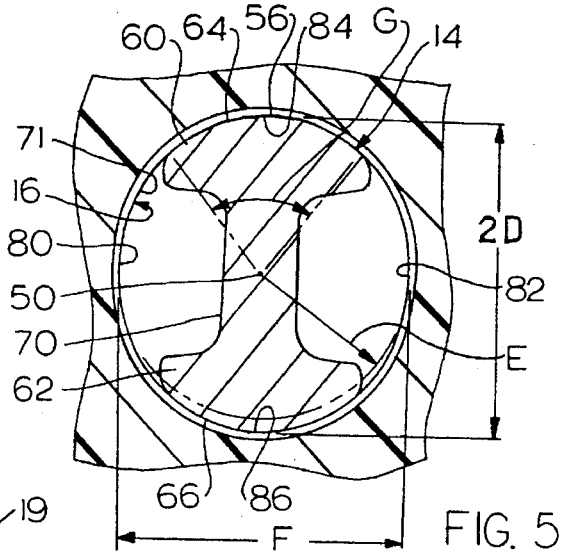
FIG. 5 is a view similar to that of FIG. 4, but showing the press-fit section lying in a circuit board hole.
Figure 6:
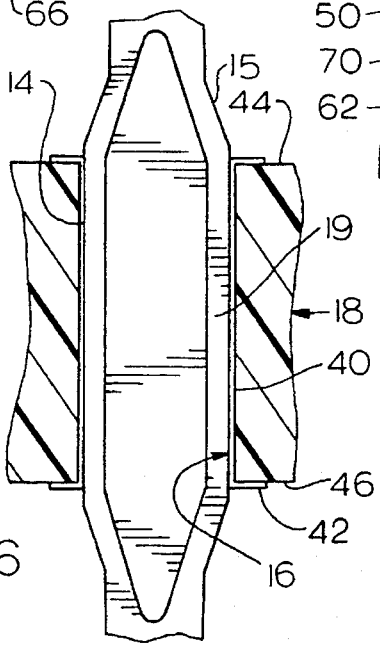
FIG. 6 is a sectional view of the combination of FIG. 5, with the circuit board shown in section and the contact shown in elevation.

FIG. 5 illustrates the press-fit section 14 of the contact after its insertion into the circuit board hole 16. The circuit board hole initially had a cylindrical shape with a round cross-section of a radius E which was about equal to the radius of curvature C (FIG. 4) of the contact outer faces. However, since the lateral width 2D of the contact press-fit section is slightly greater than the diameter 2E of the hole, the hole is distorted into the shape shown. As a result of the distortion, the lateral dimension of the hole is 2D is equal to the lateral dimension of the contact press-fit section. However, the longitudinal dimension F of the hole is a plurality of percent less than 2D. The force of the cylindrical surfaces of the outer faces 64, 66 against the walls 71 of the hole, results in high frictional contact of the contact faces against the wall holes. The large contact pressure occurs over a large area because of the large facewise contact of the faces 64, 66 with the hole walls. The large pressure which is applied over a large area, results in a large retention force. However, the forces are distributed over large areas, rather than being concentrated which could cause crazing and cracking of the circuit board.

Applicant has designed contacts of the construction shown. Each contact had a length 2D of 40 mils (1 mil equals one thousandth inch) with a tolerance of plus or minus 1 mil. The contact was designed for insertion into precisely formed holes 16 that each had an initial diameter 2E of 37 mils plus or minus 1.5 mil. The average interference was 3 mils, with the extreme cases (maximum hole diameter with minimum size contact, or minimum hole diameter with maximum size contact) being 0.5 mil and 5.5 mils. The radius of curvature C of the flange faces was 20 mils, which is 100% of the distance D. FIG. 5 illustrates a situation of average interference (about 3 mils).

The cylindrical surface 64 of each flange 60, 62 extends by an angle G so that the entire angle of contact 2G of the press-fit section with the hole walls is about one-half of a circle, and is preferably between one-quarter and three-quarters of a circle, or between a total of 90° and 270°. The particular angle G is about 80°, so the total angle of contact is about 160°. A much smaller angle of contact results in a smaller retention force due to the pressure being applied over a smaller area. A larger angle of contact is more likely to harm the circuit board, because it would not allow the longitudinally-spaced opposite sides 80, 82 of the hole to move slightly closer together to compensate for the fact that the longitudinally-spaced opposite sides 84, 86 of the hole are pressed further apart. Of course, the net result of the contact in the hole is that the hole cross-section is changed from a circle to a slightly oval shape, with the vertical height being between 5% and 10% greater than the horizontal width in most cases. It can be seen by comparing FIGS. 4 and 5, that the middle portion of the press-fit section is rigid to substantially prevent the flange outer faces 64, 66 from being deflected toward each other.

The web 70 should be thick enough to avoid bending, in which the web would allow the flanges to tilt and move closer together. As indicated in FIG. 4, applicant prefers that the longitudinal width H of the web be at least about 15% of the overall height or lateral dimension 2D of the contact section, and at least 20% of the width J of each flange. For the particular contact described above, the web width H was about 10 mils. It would be possible to use a somewhat thinner web, but because of the small dimensions involved, and the effect of moderate tolerances thereon, applicant prefers to use a somewhat wider web to avoid bending. Although the force of the hole walls will cause some compression of the web 70, this will be negligible for metals, such as a phosphor bronze (plated) that applicant prefers to use for the contact. The inner side 90 (side closest to axis 50) of each flange extends at an angle K of 7° to the lateral centerline 52.

Figure 7:
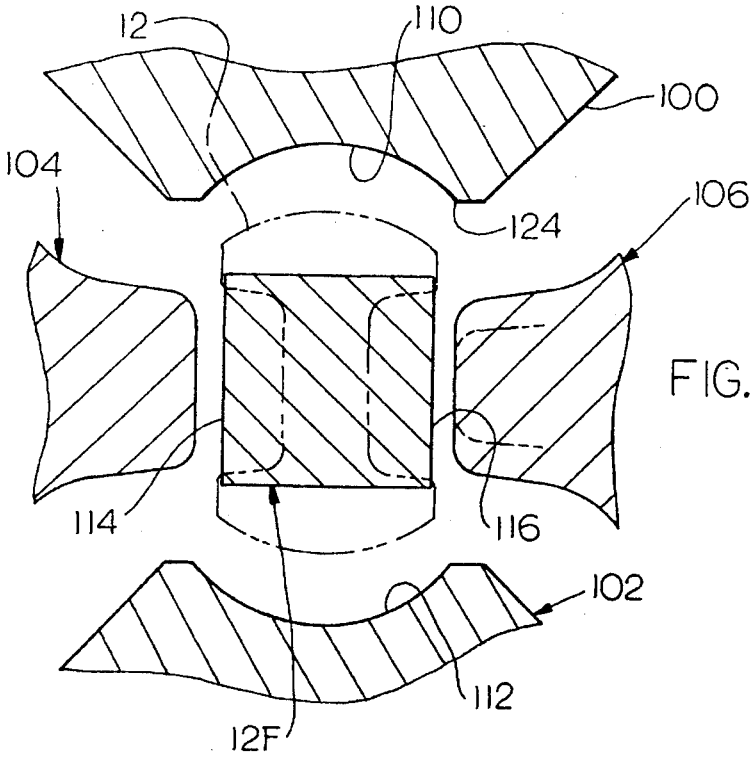
FIG. 7 is a sectional view showing the contact preform and showing the manner in which dies are used to deform the preform into the contour shown in FIG. 4.

FIG. 7 illustrates a method that applicant uses to construct the contact. Applicant first obtains a contact preform 12F from a wire or a sheet of metal. The preform has a rectangular cross-section, which is preferably square as shown, which minimizes fabrication of the top and bottom sections of the contact that extend beyond the press-fit section. The middle of the preform is placed between a pair of end dies 100, 102 and a pair of side dies 104, 106. With the preform 12F positioned as shown, all dies are moved simultaneously towards the preform. As the side dies move longitudinally towards each other, they indent opposite sides 114, 116 of the preform. The displaced material flows outwardly around the dies and against the surfaces 110, 112 of the end dies. The side dies 104, 106 are moved by selected amounts that cause the material of the preform to largely fill the cavities of the end dies, to produce a final configuration closely to that indicated at 12. The press-fit section 14 has the same cross-sectional area as the initial preform 12F and of the top and bottom sections of the contact. This avoids the necessity of removing material from the preform at least at the press-fit section.

Figure 7A:
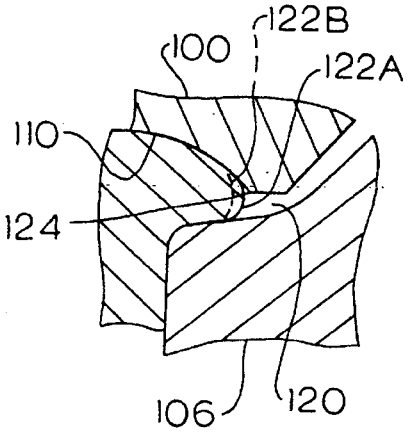
FIG. 7A is a sectional view similar to that of FIG. 7, but with the dies moved together.

FIG. 7A shows dies 100, 106 in their final positions. It can be seen that a gap 120 is left between the dies. If the preform is slightly oversize (in cross-sectional area), the flange edge at 122A will extend slightly further, while if the preform is slightly undersize, the flange end will be at 122B. In both cases, the flange edge will be rounded. The presence of the gap 120 and the use of preforms that never extend to the end 124 of the cylindrically-curved die surface 110, avoids the creation of flashing, which could break off and contaminate the circuit board. The gap thickness is a plurality of thousandths inch.

Figure 2:
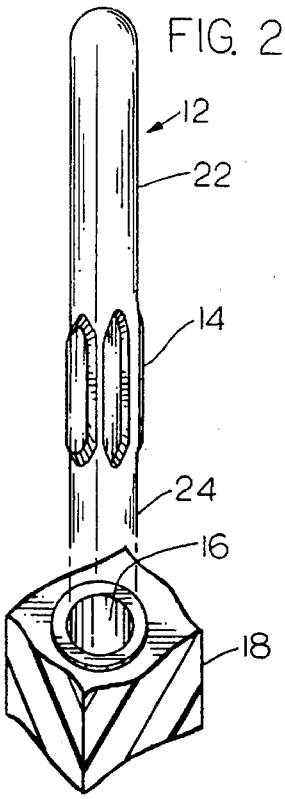
FIG. 2 is a partial isometric view of one of the contacts and a portion of the board of the combination of FIG. 1.
Figure 3:
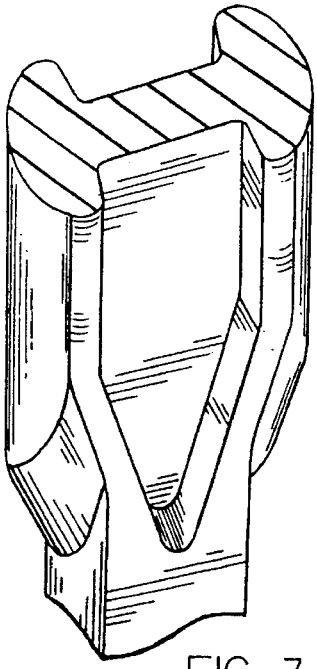
FIG. 3 is an isometric sectional view of the press-fit section of the contact of FIG. 2.

In many applications, it is desirable that the top and/or bottom sections 22, 24 (FIG. 2) be easily slidable through the circuit board hole 16. One section such as the bottom one 24 is normally passed through the circuit board hole before the press-fit section 14 is pressed into the hole. If the top section 22 also can easily slide through the hole, then the contact can be removed by pushing it down out of the hole and a new one installed from above the circuit board. It is noted that it is usually desirable that when a row of contacts are to be installed, that alternate contacts be turned 90° from one another, to minimize warping of the circuit board.

Figure 8:
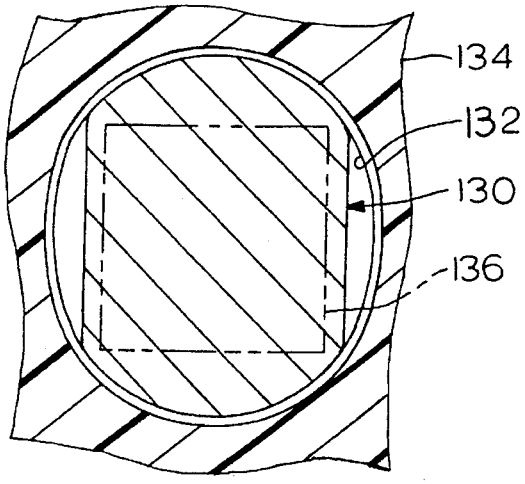
FIG. 8 is a sectional view of a combination of a circuit board and a contact press-fit section constructed in accordance with another embodiment of the invention.

FIG. 8 illustrates another electrical contact press-fit section 130 lying in a hole 132 of a circuit board 134. This contact section 130 has a disadvantage that it uses considerably more material than the contact of FIGS. 1–7, and that the contact would be more expensive to make out of a blanked piece of sheet metal whose top or bottom section has to fit through the circuit board hole but be of only slightly smaller width, as indicated at 136.

While terms such as "top," "bottom," etc. have been used herein to help describe the invention as illustrated, it should be understood that the invention and its parts can be used in any orientation with respect to Earth's gravity.

Thus, the invention provides an electrical contact with a press-fit section and a circuit board that receives it, wherein the contact can be constructed at low cost and provide a high retention force. As seen in a sectional view of the press-fit section of the contact taken along the axis, the section is of largely I-beam shape, with upper and lower flanges that each have largely cylindrical outer faces, and with a vertical web connecting the flanges. The web extends directly between the flanges and is rigid against compression and bending. The outer face of each flange is curved with a radius of curvature approximately equal to its distance from the axis of the contact section. The contact is constructed for insertion into a board hole that has a slightly smaller diameter than the distance between the outer faces of the contact section. This causes slight deformation of the hole as a result of the press-fit, but with a large area of high pressure contact between the hole walls and the flange faces. The flange faces preferably engage a total of between one-quarter and three-quarters of the entire hole inner surface, to provide a large area of contact for a large retention force, while allowing the hole to deform into a somewhat oval shape as a result of the slight deformation caused by the press-fit. The construction of the contact, with a web having a thickness less than half the lateral width of the flanges, facilitates construction of the contact at low cost, by deformation of a rectangular and preferably square portion of a longer piece of sheet metal which is preferably of the same cross-section.

Although particular embodiments of the invention have been described and illustrated herein, it is recognized that modifications and variations may readily occur to those skilled in the art, and consequently, it is intended that the claims be interpreted to cover such modifications and equivalents.

What is claimed is:

1. A combination of a circuit board which has at least one hole with substantially cylindrical hole walls extending along a vertical axis, and an electrical contact that has a press-fit section, said press-fit section having at least one transition portion and having a middle portion, said middle portion lying in interference fit in said hole and said electrical contact having a top section projecting generally upwardly above the hole, characterized by:

said middle portion of said press-fit section has a plurality of outer faces that are each of about the same radius of curvature as said hole and that lie facewise against the walls of said hole along a total angle of at least 90° but less than 270° about said axis, and the middle of said press-fit section forming a rigid structure extending between said faces and preventing said faces from moving toward each other, with the deflection of said hole walls away from said axis being greater than any deflection of said faces toward said axis.

2. The combination described in claim 1 wherein:

said middle portion of said press-fit section has a cross-section, as viewed along said axis with said middle portion lying in said board hole, which is of largely I-beam shape with upper and lower unbent rigid flanges.

3. The combination described in claim 1 wherein:

said press-fit section has two diametrically opposite flanges that each form one of said outer faces, with each outer face having a middle, as seen in a sectional view taken normal to said axis;

said hole is deformed from a round configuration, with the length through said axis, in a first direction across said hole through said middles of said outer faces, being between 5% and 10% greater than the distance in a second direction across said hole which is perpendicular to said first direction.

4. An electrical contact which has a press-fit section with an axis, and with upper and lower transition portions and a middle portion therebetween, said middle portion constructed for press fitting into a hole of a board, said electrical contact having a top section extending generally upwardly from said upper end of said press-fit section, and as seen in a sectional view of said press-fit section taken along said axis, said middle portion of said press-fit section is of largely I-beam shape with upper and lower flanges that each have outer faces for abutting the hole walls and with said shape including a web connecting said flanges, characterized by:

said web extends directly between said flanges and is rigid against compression and bending that would move said flanges closer together, and each of said flanges has a convexly curved outer face having a radius of curvature which is between 80% and 110% its distance from said axis, before insertion into said hole.

5. The contact described in claim 4 wherein:

each of said flange outer faces has a radius of curvature that is about 100% of its distance from said axis.

6. The contact described in claim 4 wherein:

said middle section forms a rigid structure that substantially prevents said flange outer faces from deflecting toward each other.

* * * * *